US012018669B2

(12) United States Patent
Nasu et al.

(10) Patent No.: US 12,018,669 B2
(45) Date of Patent: Jun. 25, 2024

(54) MULTIPLE DIAPHRAGM PUMP WITH MAGNETIC ACTUATION OF THE SPOOL VALVE TO AVOID A DEAD ZONE

(71) Applicant: Lutz Pumpen GmbH, Wertheim (DE)

(72) Inventors: Takumi Nasu, Wertheim (DE); Alexander Ries, Wertheim (DE); Andrej Getze, Kreuzwertheim (DE)

(73) Assignee: Lutz Pumpen GmbH, Wertheim (DE)

( * ) Notice: Subject to any disclaimer, the term of this patent is extended or adjusted under 35 U.S.C. 154(b) by 33 days.

(21) Appl. No.: 17/670,442

(22) Filed: Feb. 12, 2022

(65) Prior Publication Data

US 2022/0268267 A1 Aug. 25, 2022

(30) Foreign Application Priority Data

Feb. 25, 2021 (DE) ..... 102021104548.7

(51) Int. Cl.
*F04B 43/073* (2006.01)
*F01L 25/08* (2006.01)
*F04B 43/02* (2006.01)

(52) U.S. Cl.
CPC ..... *F04B 43/0736* (2013.01); *F01L 25/08* (2013.01); *F04B 43/023* (2013.01)

(58) Field of Classification Search
None
See application file for complete search history.

(56) References Cited

U.S. PATENT DOCUMENTS

| | | | | | |
|---|---|---|---|---|---|
| 5,222,876 | A * | 6/1993 | Budde | F04B 43/0736 | 417/393 |
| 5,325,762 | A * | 7/1994 | Walsh | F01L 25/08 | 91/275 |
| 5,377,719 | A | 1/1995 | Gyllinder et al. | | |
| 5,470,209 | A * | 11/1995 | Hartley | F04B 9/135 | 417/393 |
| 2008/0127946 | A1* | 6/2008 | Jeter | F04B 53/10 | 123/73 PP |

FOREIGN PATENT DOCUMENTS

| | | | | |
|---|---|---|---|---|
| CN | 106762568 | A | 5/2017 | |
| CN | 108061023 | A | 5/2018 | |
| DE | 1453607 | | 10/1972 | |
| DE | 4106180 | A1 | 4/1992 | |
| DE | 69302656 | T2 | 2/1997 | |
| DE | 19738779 | A1 | 3/1999 | |
| EP | 595116 | A1 * | 5/1994 | F01L 23/00 |
| WO | WO2010099579 | A | 9/2010 | |
| WO | WO-2010099579 | A1 * | 9/2010 | F04B 43/023 |

* cited by examiner

*Primary Examiner* — Essama Omgba
*Assistant Examiner* — Geoffrey S Lee
(74) *Attorney, Agent, or Firm* — Von Rohrscheidt Patents

(57) ABSTRACT

Multiple diaphragm pumps are known in the art that are operated by compressed air and in which the valves are controlled by a slide element. The slide element is magnetically actuated without mechanical engagement involved in the actuation. This has the consequence that only a small amount of force can be applied which may not be sufficient due to static friction of the valve seal. The invention presents a hybrid solution which facilitates a mechanical actuation of a valve piston provided for valve control as well as a magnetic overcoming of a dead center that may be reached by the valve piston and the diaphragm piston that actuates the diaphragms of the multiple diaphragm pump.

8 Claims, 3 Drawing Sheets

MULTIPLE DIAPHRAGM PUMP WITH MAGNETIC ACTUATION OF THE SPOOL VALVE TO AVOID A DEAD ZONE

RELATED APPLICATIONS

This application claims priority from German Patent Application DE 10 2021 104 548.7 filed on Feb. 25, 2021 which is incorporated in its entirety by this reference.

FIELD OF THE INVENTION

The invention relates to a multiple diaphragm pump.

BACKGROUND OF THE INVENTION

A generic multiple diaphragm pump configured as a double diaphragm pump is known from DE 41 06 180 A1. Thus, identically oriented radially arranged annular magnets are positioned on the diaphragm piston and on the valve piston on interacting end pieces of the diaphragm piston and the valve piston. The diaphragm piston and the valve piston operate counter-acting in that a magnet field of the diaphragm piston urges the valve piston in an opposite direction of the passing diaphragm piston. The oscillating movement of the mechanically driven diaphragm piston arranges identical poles of the radial magnets of both pistons in parallel periodically. The magnet field of the valve piston gets displaced by the resistance created by the approximation of the identical poles in that the annular magnets displace the valve piston into a position relative to the diaphragm piston. Thus, opposite poles of the annular magnets of the diaphragm piston generate a maximum attraction force with the respective opposite poles of the valve piston. The propensity of both magnetic fields to be in a stationary position relative to each other functions to operate the valve and the propellant inflow since the valve piston can only be controlled magnetically.

The arrangement of the magnets described supra does not make optimum use of the magnet forces since a friction resistance of the valve seals has to be overcome directly by the magnet forces. On the other hand, side, the magnet forces are strongly correlated with the distance of the magnets. Since the magnetic fields are not moved towards a center of the respective opposite magnets but merely a displacement past the magnets is performed this maximum force is not being used in the prior art. This would not work in the prior art either since the magnetic force is not only required in the end position but on the entire path of the mutual displacement of the two pistons.

DE 693 02 656 T2 provides a simple parallel support of diaphragm piston and valve piston where the valve piston is moved directly back and forth between 2 contact surfaces.

BRIEF SUMMARY OF THE INVENTION

Thus, it is an object of the invention to provide a multiple diaphragm pump where magnetic forces are used more efficiently through a different distribution on the two pistons in order to prevent a stand-still of the multiple diaphragm pump in a common dead center of diaphragm piston and valve piston.

The object is achieved by a multiple diaphragm pump, comprising: a first diaphragm chamber separated by a first diaphragm into a first propellant chamber and a first media chamber; a second diaphragm chamber separated by a second diaphragm into a second propellant chamber and a second media chamber, wherein a diaphragm piston mechanically couples the first diaphragm and the second diaphragm and extends into a switch housing and cooperates with a valve piston to control an inflow and outflow of propellant into and out of the first propellant chamber and the second propellant chamber, wherein a magnet arrangement including a first magnet arrangement and a second magnet arrangement is arranged between the diaphragm piston and the valve piston, wherein the diaphragm piston cooperates mechanically with the valve piston to actuate a valve so that the first magnet arrangement arranged at the valve piston is moved from an idle position in a plane of the second magnet arrangement arranged at the diaphragm piston, wherein the second magnet arrangement is arranged parallel and coaxial to the first magnet arrangement, wherein the valve piston is supported parallel or coaxial to the diaphragm piston, wherein one of the valve piston and the diaphragm piston forms a head piece that is received in a cage formed by another of the valve piston and the diaphragm piston, wherein the head piece forms a head piece contact surface and the cage forms cage contact surface, wherein the head piece contact surface and the cage contact surface face each other, and wherein a clearance is provided between the head piece contact surface and the cage contact surface. Advantageous embodiments of the multiple diaphragm pump can be derived from the dependent claims.

According to the invention, a multiple diaphragm pump is provided where the membranes are mechanically coupled by a diaphragm piston. The diaphragms respectively divide a diaphragm chamber into a propellant chamber and a media chamber. The membrane piston transfers a portion of its movement to the valve piston within a switch housing by taking the valve piston along. By being taken along the valve piston switches a valve arranged at an end of the valve piston so that the valve shuttles back and forth between two switching positions and thus controls an inflow and an outflow of the propellant into and out of the propellant chambers. In addition to taking the valve piston along through the oscillating movement of the diaphragm piston, a portion of the path is travelled magnetically. The common dead center of both pistons is located in this portion of the path. The dead center is a position of the pistons from which the multiple diaphragm pump cannot move under its own power so that external interference is required. This is achieved in particular when the valve piston stops in an intermediate position where no defined valve position is reached and no pressure and no velocity of the diaphragm piston exists anymore to mechanically move the valve piston any further. Should both pistons simultaneously go into dead center the multiple diaphragm pump comes to a stand-still since all valves that control the propellent are open in this position. Plural magnet arrangements that are advantageously arranged parallel or also coaxial and which form part of interacting head pieces of both pistons according to the invention generate a magnetic force which is strong enough to move the pistons from their respective dead centers.

Thus, this arrangement is particularly advantageous since it minimizes the push travel that has to be provided by the magnet forces by themselves and a more efficient arrangement of the magnets makes better use of the magnet force. Thus, the friction resistance of the valve seals is overcome by the mechanism of the diaphragm piston and not by the magnetic field of the valve piston. The magnetic field merely assures that both pistons do not reach their dead center simultaneously which would stop the movement of the double diaphragm pump.

It has proven particularly advantageous when the valve piston runs coaxial with the diaphragm piston or at least parallel to the diaphragm piston. In this embodiment a force of the diaphragm piston can be used directly for mechanically actuating the valve piston though no rigid coupling is implemented. This arrangement rather uses a mechanical coupling which provides a clearance between the valve piston and the diaphragm piston. Thus, the offset of the valve piston can be in particular larger than the offset of the diaphragm piston. This can also facilitate a timing offset between the movements of valve piston and diaphragm piston so that the valve remains in a defined position also during the movement of the diaphragm piston.

In an advantageous embodiment, one of the two pistons can form a head piece that is received in a cage formed by the other of the two pistons wherein the head piece and the cage form forward and rear stop surfaces in the push direction and in the pull direction wherein a clearance is provided between head piece contact surfaces and cage contact surfaces. Independently from which of the two components is associated with which of the two pistons, it is advantageous when the interaction between the diaphragm piston and the valve piston is provided by an overlapping configuration. Thus, the free end of the valve piston can be advantageously formed as a cage whereas the free end of the diaphragm piston that interacts with the valve head piece in the pull direction and in the push-direction forms a head piece which is received in the cage longitudinally movable.

Furthermore, first magnet arrangements can be associated with the cage contact surfaces and at least one second magnet arrangement can be associated with the head piece wherein the at least one second magnet arrangement is oriented opposite to the first magnet arrangement. Thus, the cage and the head piece repel each other shortly before reaching the end position of the cage. The head piece then pushes the cage mechanically and magnetically until a contact position of the cage is reached.

Thus, the inner walls of the cage can function as contact surfaces for corresponding contact surfaces of the head piece. In a movement cycle the diaphragm piston is moved by the diaphragms that are displaced by a propellant inflow and outflow so that the head piece and the cage move relative to each other. While the valve piston initially stays stationary, so that the valve maintains its position the head piece traverses the cage and contacts the cage contact surfaces at an opposite side of the cage. From this moment on the valve piston is moved along mechanically by the diaphragm piston.

The cage that moves in the switch housing of the multiple diaphragm pump can be in turn movably arranged between two housing contact surfaces. This facilitates to fix the cage between two extreme points of the movement and provides that the cage is always in a defined position within the switch housing.

Furthermore, identically oriented third magnet arrangements can be provided in the housing stop surfaces with the first magnet arrangements wherein the third magnet arrangements attract the first magnet arrangements in the cage contact surfaces and help to overcome the last portion of the travel path towards the housing contact surfaces. When the head piece moves back within the cage, the head piece contacts the opposite cage contact surfaces and from this moment on moves the cage along in the opposite direction mechanically and magnetically. Therefore, outer cage contact surfaces are attracted by the housing contact surfaces as soon as the head piece with the identical pole repels the cage from an inside so that the cage is moved by the magnetic force towards the housing stop. Therefore, the cage is moved over the dead center of the valve piston by the repelling of identical poles from the inside as well as by the attraction of opposite poles from the outside.

It has proven advantageous when the valve piston actuates a valve arrangement, advantageously a 5/2-way valve to control the propellant flow into the propellant chambers. In particular the 5/2-way valve can be arranged at the other end of the valve piston in order to assure the inflow and outflow of the propellant into and from the propellant chambers of the double diaphragm pump. This valve facilitates controlling the inflow and outflow of the propellant of both propellant chambers simultaneously wherein one propellant chamber is filled with the propellant while the propellant can simultaneously exit from the other chamber.

The magnet arrangements can be construed simultaneously from one or plural magnet that are arranged with identical polarity, in particular spatially distributed. Thus, the poles of all magnet arrangements that share a contact surface can be oriented either parallel or perpendicular to the movement direction as long as the identical arrangement described supra or the opposite arrangement is assured that is required to use the applied magnetic fields for the movement of the valve piston. Thus, it is possible e.g. to arrange a magnet at the head piece as long as the head piece is sufficiently thinned. For a thicker head piece, it can be useful to arrange a magnet at both sides of the head piece wherein the magnets at both sides of the head piece then jointly form the magnet arrangement. This applies accordingly to the other contact surfaces and also provides a simple way to reinforce the magnets.

Particularly advantageously the magnets are permanent magnets, in particular neodymium magnets which are advantageously configured as ring magnets. Selecting neodymium magnets assures that the magnet force suffices to mobilize the valve piston. Additionally, a permanent magnet functions without interruption which helps reliability of the design and makes it maintenance free.

In a particularly advantageous embodiment compressed air can be used as a reliable propellant. This gas is available everywhere and merely has to be compressed. Air is particularly advantageous since it does not corrode the propellant chambers and diaphragms and is movable quickly and easily.

BRIEF DESCRIPTION OF THE DRAWINGS

The invention is now described in more in detail based on an advantageous embodiment with reference to drawing figures, wherein.

DETAILED DESCRIPTION OF THE INVENTION

Figure 1:
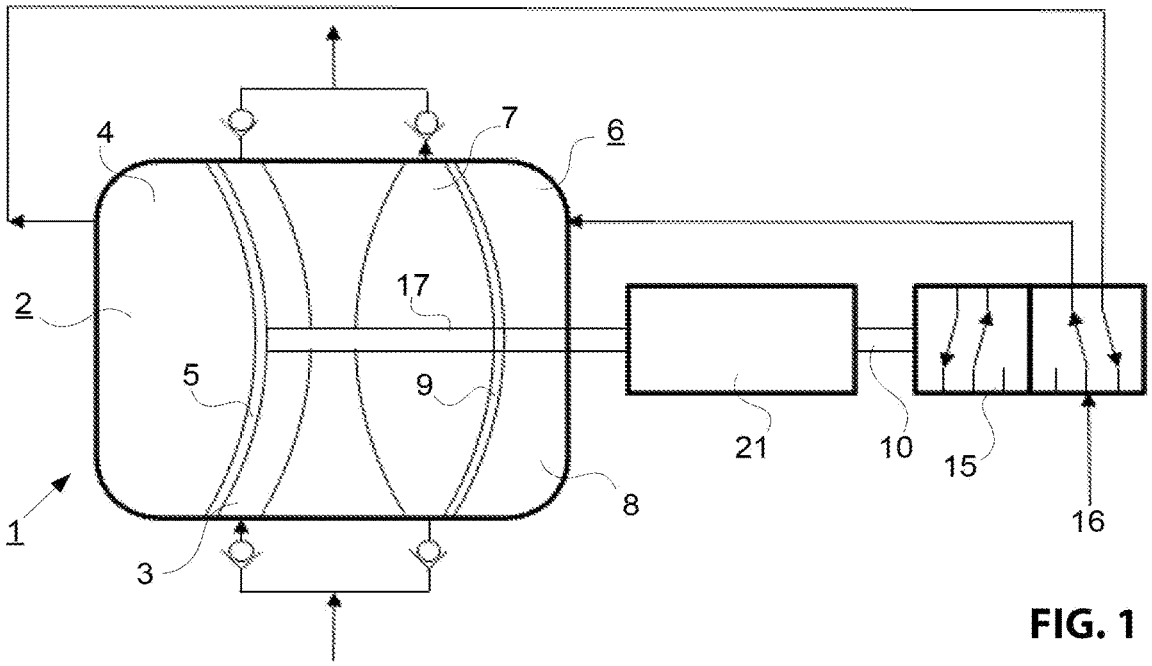
FIG. 1 illustrates a multiple diaphragm pump configured as a double diaphragm pump including a propellant valve which is connected through a switch housing with a diaphragm piston shown in a first switching position.

FIG. 1 shows a double diaphragm pump 1 that includes two diaphragm chambers 2 and 6. The diaphragm chambers 2 and 6 are divided by a respective diaphragm 5 and 9 into a propellant chamber 4 and 8 and a media chamber 3 and 7. Compressed air is conducted from a propellant source 16 through a valve arrangement 15 that is configured as a 5/2 way valve into the second propellant chamber 8 in order to move the second diaphragm 9 against the pressure of the medium included in the second media chamber 7 towards the second media chamber 7 and feed the medium from the second media chamber 7. Thus, the second diaphragm 9 is coupled through a diaphragm piston 17 with a first diaphragm 5 so that the second diaphragm moves with the first diaphragm so that the first diaphragm 5 feeds propellant from the first propellant chamber 4 through the valve arrangement 15. This in turn expands the first media chamber 3 and pulls media into the first media chamber 3

Figure 5:
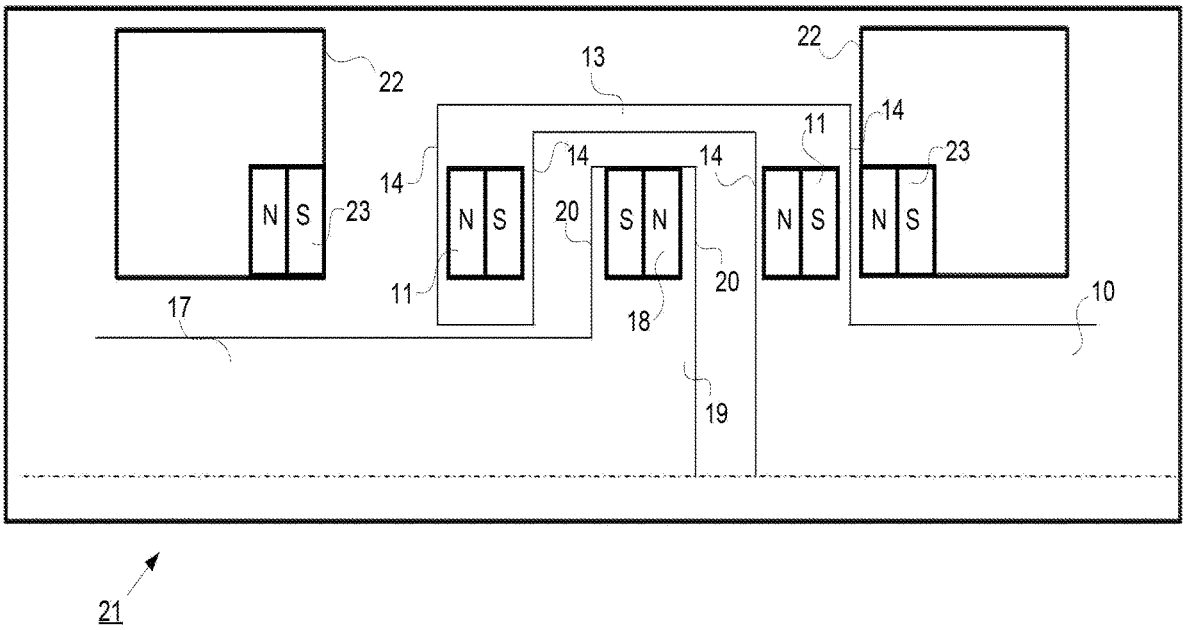
FIG. 5 illustrates a connection between the diaphragm piston and a valve piston connected with the valve within the switch housing.

The valve position of the valve arrangement 15 is thus actuated by a valve piston 10 that is mechanically connected with the diaphragm piston 17 as illustrated in FIG. 5.

Figure 2:
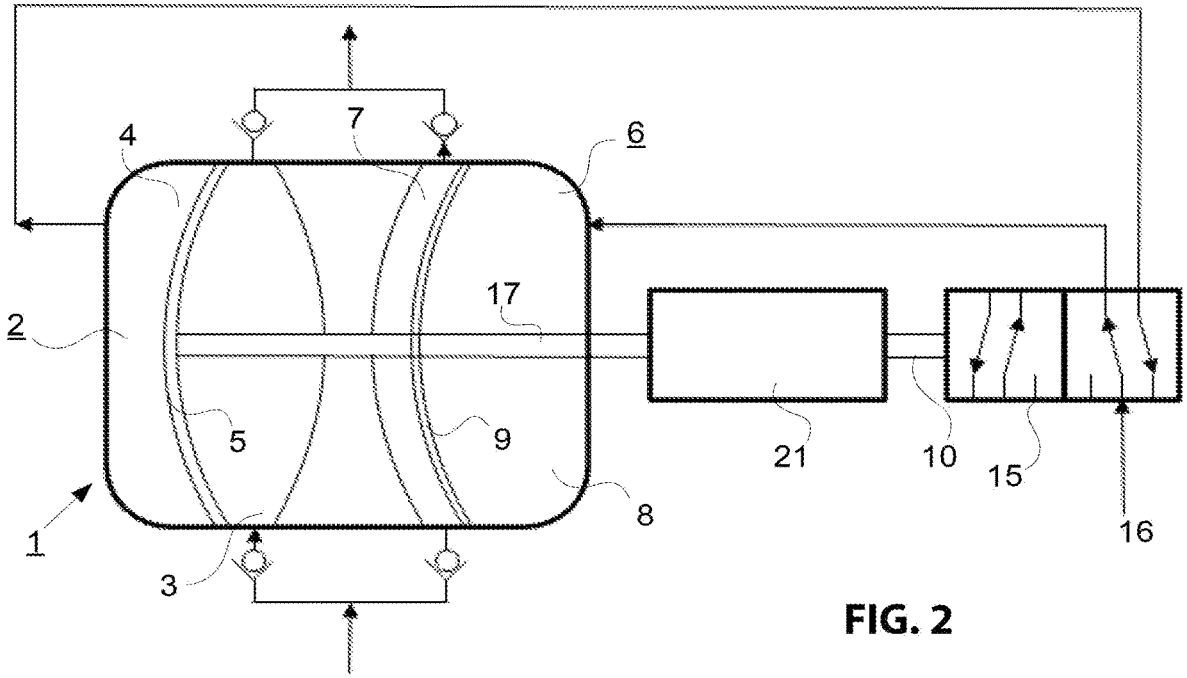
FIG. 2 illustrates the double diaphragm pump according to FIG. 1 in a second switching position.

FIG. 2 shows the subsequent step where the diaphragms 5 and 9 are displaced in opposite directions wherein clearance and time offset are provided between the diaphragm piston 17 and the valve piston 10 so that the valve arrangement 15 still is in the prior position at this point in time.

Figure 3:
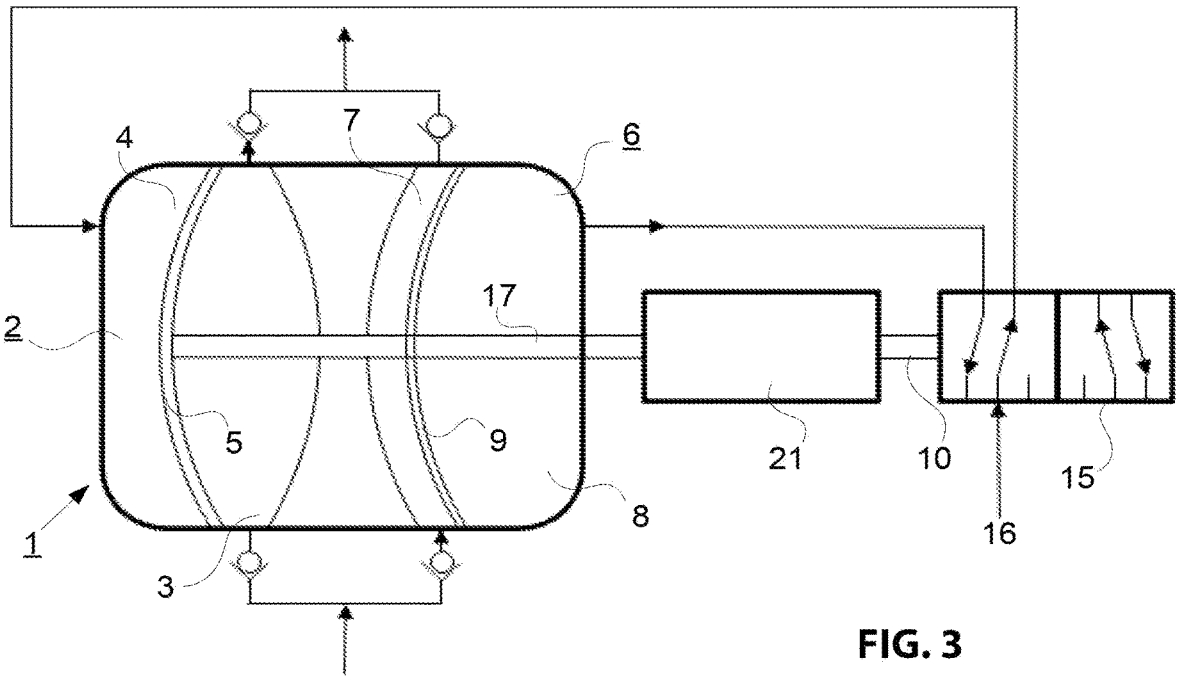
FIG. 3 illustrates the double diaphragm pump according to FIG. 1 in a third switching position.

FIG. 3 illustrates the next step where the valve arrangement 15 has switched so that the 5/2-way valve supplies the first propellant chamber 4 with compressed air while the diaphragms 5 and 9 now commence to displace the medium from the first media chamber 3 and the compressed air from the second propellant chamber 8.

Figure 4:
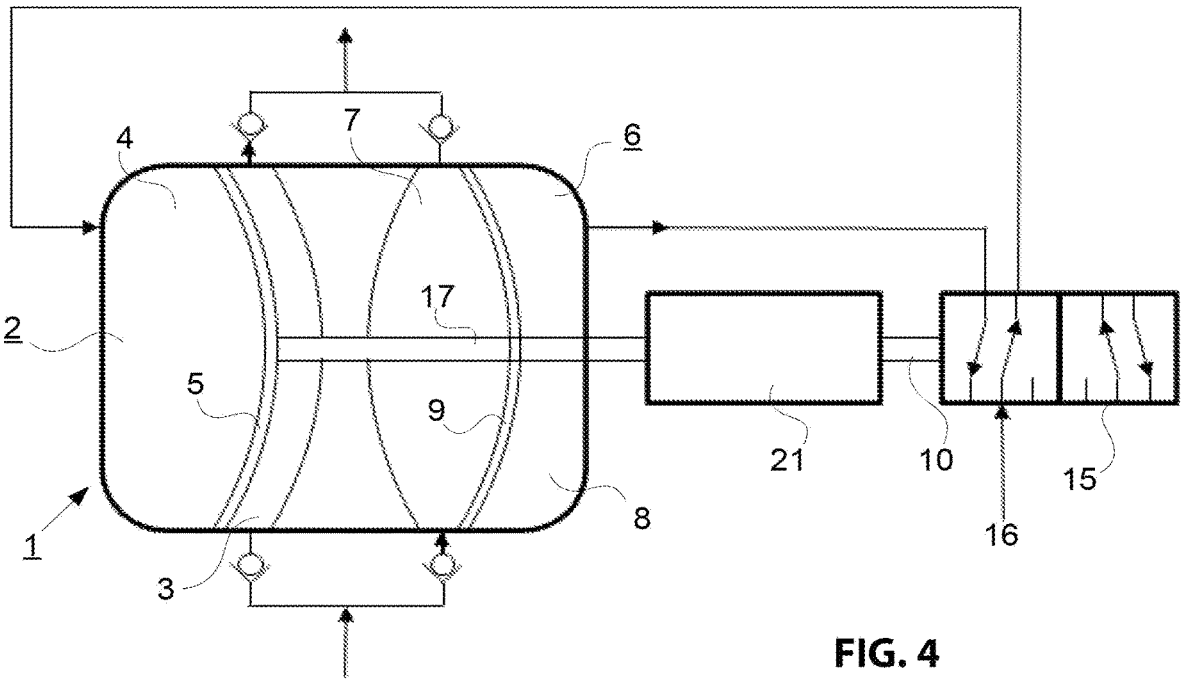
FIG. 4 illustrates the double diaphragm pump according to FIG. 1 in a fourth switching position.

This is completed in FIG. 4 in which the valve arrangement 15 has not switched yet, however the diaphragm valve piston 17 approaches the end position.

FIG. 5 illustrates the interior of the switch housing 21 that causes the switching, wherein the diaphragm piston 17 protrudes into the switch housing from the left side and valve piston 10 protrudes into the switch housing from the right side. Thus, the free end of the diaphragm piston 17 forms a head piece 19 which is received in a cage 13 at the free end of the valve piston 10. Thus, the headpiece 19 has clearance in the cage 13 similar to a piston in a cylinder so that a movement of the diaphragm piston 17 impacts the movement of the valve piston 10 directly only when the head piece 19 contacts a cage contact surface 14 of the cage 13 with head piece contact surfaces 20 and presses against the contact surface of the cage 13. Due to this mechanical coupling the diaphragm piston 17 can move the valve piston 10 into a switching position where the cage 13 of the valve piston 10 contacts housing contact surfaces 22 of the housing 21. Typically, this position is not reached due to the movement of the diaphragm piston 17 alone, rather the valve piston 10 may stop in a dead center shortly before the switching position where the valve is not in a clear switching position and the membrane piston 17 does not move any further due to the lack of pressure in the membrane chambers 2 and 6. For this case, magnet arrangements 11, 18 and 23 are arranged in the cage 13, the head piece 19 and the housing contact surfaces 22 wherein the magnet arrangements are configured to avoid this dead center.

Thus, first magnet arrangements 11 are arranged in the cage and third magnet arrangements 23 are arranged in the housing contact surfaces with identical orientations so that they attract each other. The third magnet arrangements can be omitted if necessary but the third magnet arrangements pull the cage 13 magnetically against the housing contact surfaces 22 in an end position of the cage 13 and thus help to overcome the undefined dead center position. An opposite second magnet arrangement 18 urges the cage 13 towards the end position in the end positions since identical poles are oriented towards each other and repel each other. This way a dwelling of the valve piston in the dead center can be prevented due to the attraction of the cage 13 due to the cooperation of the first magnet arrangement 11 and the third magnet arrangement 23 thus also because of the rejection between the second magnet arrangement 18 of the head piece 19 and the first magnet arrangement 11 of the cage 13 toward the housing contact surface 22.

The diaphragm pump described supra makes more efficient use of the magnet forces due to the distribution of the magnets over both pistons in order to prevent a stand-still of the mufti-diaphragm pump in a common dead center of diaphragm piston and valve piston.

REFERENCE NUMERALS AND DESIGNATIONS 1 double diaphragm pump
2 first diaphragm chamber
3 first media chamber
4 first propellant chamber
5 first diaphragm
6 second diaphragm chamber
7 second media chamber
8 second propellant chamber
9 second membrane
10 valve piston
11 first magnet arrangement
13 cage
14 cage contact surface
15 valve arrangement
16 propellant source
17 diaphragm piston
18 second magnet arrangement
19 head piece
20 head piece contact surface
21 switch housing
22 housing contact surface
23 third magnet arrangement

What is claimed is:

1. A multiple diaphragm pump, comprising:

a first diaphragm chamber separated by a first diaphragm into a first propellant chamber and a first media chamber;

a second diaphragm chamber separated by a second diaphragm into a second propellant chamber and a second media chamber;

wherein a diaphragm piston mechanically couples the first diaphragm and the second diaphragm and extends into a switch housing and cooperates with a valve piston to control an inflow and outflow of propellant into and out of the first propellant chamber and the second propellant chamber, wherein a magnet arrangement including a first magnet arrangement and a second magnet arrangement is arranged axially between the diaphragm piston and the valve piston, wherein the diaphragm piston cooperates mechanically with the valve piston to actuate a valve so that the first magnet arrangement arranged at the valve piston is moved from an idle position in a plane of the second magnet arrangement arranged at the diaphragm piston, wherein the second magnet arrangement is arranged parallel and coaxial to the first magnet arrangement, wherein the valve piston is supported parallel or coaxial to the diaphragm piston, wherein one of the valve piston and the diaphragm piston forms a head piece that is received in a cage formed by another of the valve piston and the diaphragm piston, wherein the head piece forms an axially oriented head piece contact surface and the cage forms an axially oriented cage contact surface, wherein the axially oriented head piece contact surface and the axially oriented cage contact surface face each other axially, wherein an axial clearance is provided between the axially oriented head piece contact surface and the axially oriented cage contact surface, wherein the first magnet arrangement is associated with the axially oriented cage contact surface when the cage is formed at the valve piston and the second magnet arrangement is associated with the axially oriented head piece contact surface when the head piece is formed at the diaphragm piston, or wherein the first magnet arrangement is associated with the axially oriented head piece contact surface when the head piece is formed at the valve piston and the second magnet arrangement is associated with the axially oriented cage contact surface when the cage is formed at the diaphragm piston, wherein the second magnet arrangement is oriented opposite to the first magnet arrangement, wherein the cage is displaceable in a linear manner between two axially oriented housing contact surfaces, wherein third magnet arrangements are associated respectively with the two axially oriented housing contact surfaces, and wherein the third Magnet arrangements are fixed at the housing and oriented identical to the first magnet arrangement.

2. The multiple diaphragm pump according to claim 1, wherein the valve piston actuates the valve configured as a 5/2-way valve to control a propellant flow into the propellant chambers.

3. The multiple diaphragm pump according to claim 1, wherein magnets of the magnet arrangements are permanent magnets or a neodymium magnets configured as ring magnets.

4. The multiple diaphragm pump according to claim 1, wherein the propellant is compressed air.

5. The multiple diaphragm pump according to claim 1, wherein an entirety of the second magnet arrangement is arranged axially between magnets of the first magnet arrangement.

6. The multiple diaphragm pump according to claim 1, wherein an entirety of the first magnet arrangement and an entirety of the second magnet arrangement is arranged axially between magnets of the third magnet arrangement.

7. The multiple diaphragm pump according to claim 1, wherein the valve is arranged outside the switch housing.

8. The multiple diaphragm pump according to claim 1, wherein an axial contact force is transferable between the axially oriented head piece contact surface and the axially oriented cage contact surface.

* * * * *